United States Patent [19]

Levenhagen

[11] 4,159,062

[45] Jun. 26, 1979

[54] COMBINATION SERVING TRAY AND COVER

[75] Inventor: Alvin W. Levenhagen, Linesville, Pa.

[73] Assignee: Molded Fiber Glass Tray Company, Linesville, Pa.

[21] Appl. No.: 854,472

[22] Filed: Nov. 23, 1977

[51] Int. Cl.[2] ..... B65D 11/02; B65D 43/08

[52] U.S. Cl. ..... 220/4 B; 206/518; 220/352

[58] Field of Search ..... 220/4 B, 220/4 E, 352; 206/518, 519

[56] References Cited

U.S. PATENT DOCUMENTS

| | | | |
|---|---|---|---|
| 2,186,365 | 1/1940 | Castles | 220/4 B |
| 2,722,778 | 11/1955 | Carufel | 220/4 B |
| 3,326,408 | 6/1967 | Ringlen | 206/518 |
| 3,401,828 | 9/1968 | Bockenstette | 220/4 B |
| 3,982,651 | 9/1976 | Braun | 220/4 B |

FOREIGN PATENT DOCUMENTS

| | | | |
|---|---|---|---|
| 13516 | 7/1933 | Australia | 220/352 |

*Primary Examiner*—George E. Lowrance
*Attorney, Agent, or Firm*—Charles L. Lovercheck

[57] ABSTRACT

A tray and lid combination; the tray has sides and ends extending upwardly from the bottom at a slight angle, terminating in a flat peripheral shoulder. The lid has a flat top and downwardly and outwardly extending sides and ends that terminate in a flat peripheral shoulder that rests on the shoulder of the tray. Each corner of the lid has an integral projection formed on it that fits into the corner of the tray and functions as a lock to prevent the lid from coming off of the tray.

4 Claims, 6 Drawing Figures

COMBINATION SERVING TRAY AND COVER

GENERAL DESCRIPTION OF THE INVENTION

The tray is designed so as to provide a patient tray useful in hospitals, which is a shallow unit with a cover that will not readily slide off. The advantages of the cover are that the engaging features are integral through the lid and are cleanable in a washing machine. The projections function as a lock to prevent the cover from coming off of the tray and are self draining and adapted to be run through a dishwasher. Most trays depend on some type of a mechanical lock in order to hold the trays together while in transit. The lugs on either end are designed to support the tray and the cover when they are nested, as well as when they are being carried in a rack system such as carts or conveyors.

REFERENCE TO PRIOR ART

Applicant knows of no tray and cover combination such as disclosed herein.

OBJECTS OF THE INVENTION

It is an object of the invention to provide a tray and cover combination which is specially adapted to be cleaned in an automatic dishwasher and from which the cover will not easily slide.

Another object of the invention is to provide a cover that is simple in construction, economical to manufacture and simple and efficient to use.

Another object of the invention is to provide a simple and efficient and ultra-sanitary tray and cover combination.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
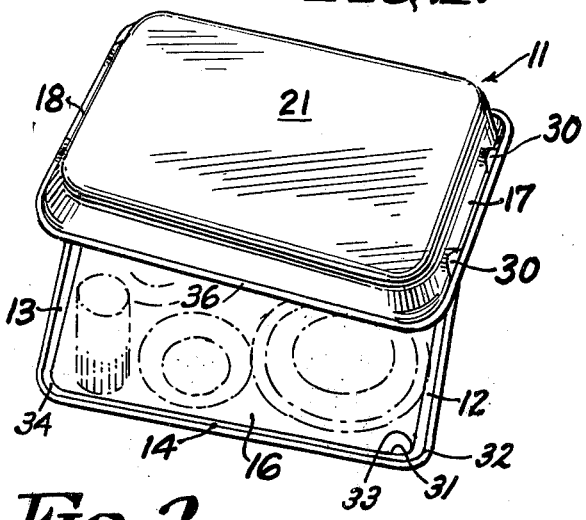
FIG. 1 is an isometric view showing the tray and cover removed therefrom.
Figure 4:
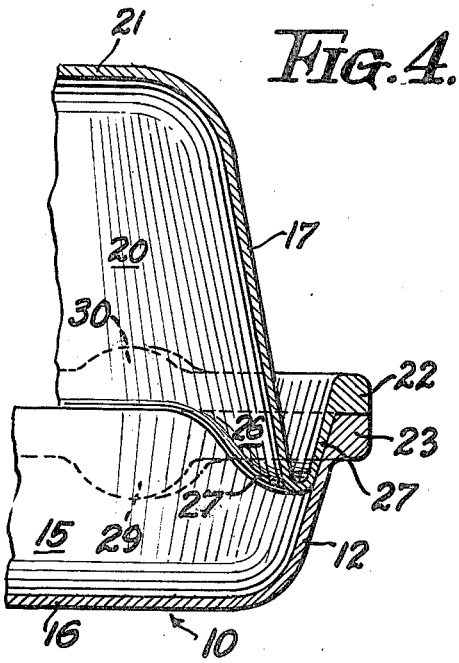
FIG. 4 is an enlarged cross-sectional view taken on line 4—4 of FIG. 2, with the cover in place on the tray.
Figure 2:
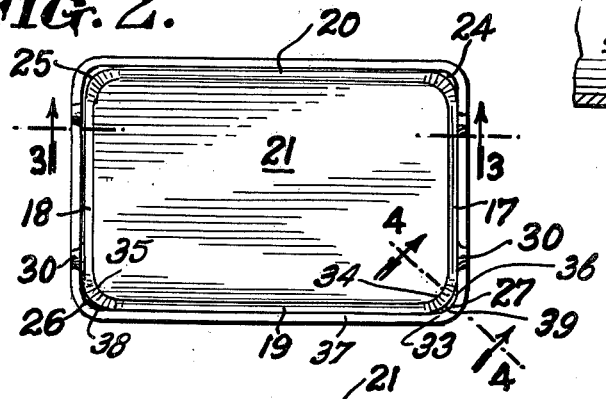
FIG. 2 is a bottom view of the cover.
Figure 3:
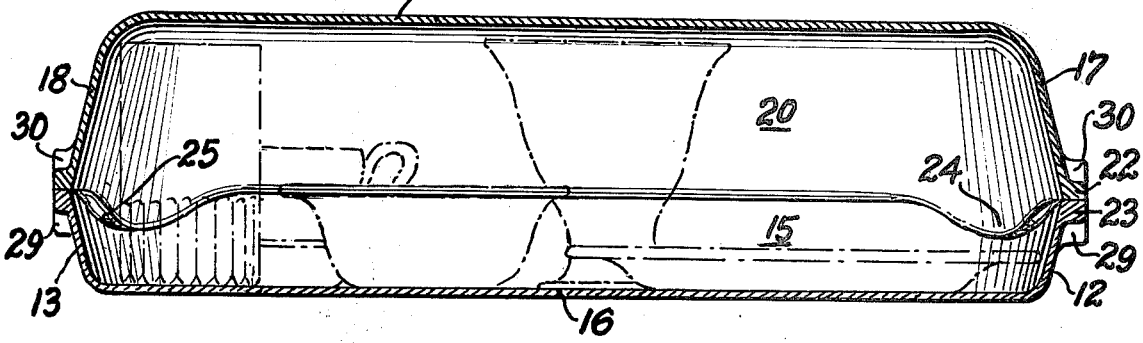
FIG. 3 is a longitudinal, cross-sectional view taken on line 3—3 of FIG. 2.

Now, with more particular reference to the drawings, they show a tray 10 and a cover 11. The tray 10 has first ends 12 and 13 and first sides 14 and 15 terminating at their upper end in a bead 23 with an upwardly facing shoulder that are integrally attached to the bottom 16.

The cover 11 has ends 17 and 18 and sides 19 and 20 integrally connected to the top 21 and extending downwardly therefrom at a small angle and a peripheral bead 22 that extends all around it and is co-extensive with the corresponding bead 23 of the tray. Bead 22 is integrally connected to the upper end of the ends 17 and 18 and the upper side of the sides 19 and 20.

Each corner of the cover has a downwardly extending projection 24, 25, 26, and 27 thereon. These projections have an inside surface 26 that extends downwardly as a continuation of the sides and ends of the cover at the corner and have an outside surface 27 that has an outer contour complementary in shape to the inside corner surface 28 of the tray. Thus, the projections 24, 25, 26, and 27 fit down into the corners of the tray snuggly and hold the cover against lateral sliding movement.

Figure 5:
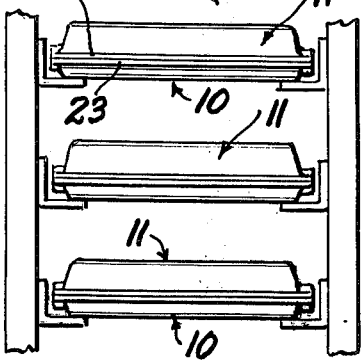
FIG. 5 is a view showing the tray and cover combination stacked on a rack, the rack supporting the bottom of the tray.
Figure 6:
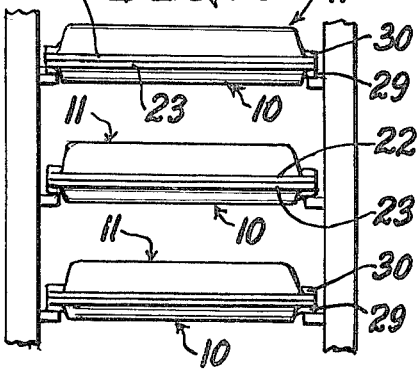
FIG. 6 is a view, similar to FIG. 5, showing the trays stacked on another type of rack with the lugs supporting the edge of the rim.

Lugs 29 are formed on the underside of the flange 23 of the tray and lugs 30 are formed on the upper side of the flange 22 of the lid. These lugs provide a support for the tray and for the cover when they are nested and provide a support for supporting the tray and the cover when they are being carried in a rack as shown in FIG. 6. When they are carried on a rack, such as shown in FIG. 5, the lugs, as well as the tray, are supported above the supports of the rack.

The projections 24, 25, 26 and 27 can be formed by inclining the corner of the cover downward from the top 21 at a steeper angle than said sides, and the outside of said lugs extends upward at an angle equal to the angle of the sides 16, 17, 18 and 19 of the tray. The ends of 12 and 13 and sides 14 and 15 join each other at the rounded first corner 33 on a first radius 31. The tray bead 36 is rounded at a first corner 33 on a second radius 32. The cover, sides 19 and 20 join the ends at second rounded corner 34 on a third radius 35. The cover, sides and ends 17, 18, 19 and 20 terminate the upper edges in the cover bead 37 which rests on the tray bead flat surfaces and have corners connecting the tray bead 36 on a fourth radius 38 equal to said second radius 32. The projections 24, 25, 26 and 27 have inner sides forming a continuation of the second rounded corner 34 and the projections have outside surfaces curving downwardly and inwardly from said tray bead corners on a convexed surface conforming to said first rounded corner 33 of the tray. A convex surface 39 integrally attached to the outer curved surface of the projections and to the inner curved surface of the projections provides a continuous surface which is adapted to avoid the deposit of foreign material thereon.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A tray and cover combination comprising,
   a tray having ends (12,13), sides (14,15) and bottom (16),
   said bottom (16) integrally connected to said sides and said ends,
   said sides and said ends extending upwardly and outwardly from said bottom and terminating in a tray bead (36) forming a flat surface,
   said ends (12,13) and said sides (14,15) joining each other at rounded first corners (33) on a first radius (31), said tray bead (36) being rounded at said first corner (33) on a second radius (32), said cover having ends (17,18) and sides (19,20) and a top (21) integrally connected to said sides and ends, said ends (17,18) and sides (19,20) of said cover joining each other at second rounded corners (34) of a third radius (35), a cover bead (37), said ends of said sides of said cover (17,18,19 and 20) terminating at their upper edges in said cover bead (37), said cover bead (37) having flat surfaces resting on said tray bead flat surfaces (36) and having corners connecting said tray bead (36) on a fourth radius (38) equal to said second radius (32), an integral projection (24,25,26, and 27) on said cover at each corner extending downwardly, said projections (24,25,26 and 27) having inner sides forming a continuation of said second rounded corner (34), said projections having outside surfaces curving downwardly and inwardly from said tray bead corners on a curved surface conforming to said first rounded corner (33) of said tray, the lower surface of said projections comprising, a convex surface (39) integrally attached to said outer curved surface of said projections and to said inner curved surface of said projections, whereby a continuous surface is provided which is adapted to avoid the deposit of foreign material thereon.

2. The combination recited in claim 1 wherein said tray bead has spaced lugs on the lower side thereof adapted to rest on supports on a rack or the like for holding said bead in spaced relation to said rack.

3. The combination recited in claim 2 wherein said cover bead has projections on the upper side thereof adapted to support said cover on said tray in inverted position spaced above.

4. The combination recited in claim 1 wherein said outer surface of said cover corners are formed by dishing the material of said cover downwardly forming recesses at the four corners of said cover.

* * * * *